United States Patent [19]

Binder

[11] 4,004,773

[45] Jan. 25, 1977

[54] CANDLE MOLD

[76] Inventor: William R. Binder, 2101 Black Horse Drive, Warrington, Pa. 18976

[22] Filed: July 29, 1974

[21] Appl. No.: 492,433

[52] U.S. Cl. ..... 249/93; 249/97; 249/102; 425/803

[51] Int. Cl.[2] ..... C11C 5/02

[58] Field of Search ..... 249/93, 102–104, 249/160, 204, 142; 425/803

[56] References Cited

UNITED STATES PATENTS

| | | | |
|---|---|---|---|
| 3,163,908 | 1/1965 | Lawmaster | 249/134 |
| 3,345,031 | 10/1967 | Fell et al. | 249/204 |
| 3,806,078 | 4/1974 | Achzehner | 425/803 X |
| 3,831,899 | 8/1974 | Doig | 425/803 X |
| 3,867,501 | 2/1975 | Powers et al. | 425/803 X |

FOREIGN PATENTS OR APPLICATIONS

| | | | |
|---|---|---|---|
| 349,521 | 3/1905 | France | 425/803 |

*Primary Examiner*—Robert D. Baldwin
*Attorney, Agent, or Firm*—Z. T. Wobensmith, 2nd; Z. T. Wobensmith, III

[57] ABSTRACT

A candle mold is described having a barrel open at each end, with a plate in sealing contact with one end removably held thereto by a flexible end cap which fits over the barrel and plate forming a mold into which wax can be formed. The end cap has a centrally located hole for engagement of a wick which passes therethrough and through a centrally located hole in the plate to the end of the barrel where it may be retained by a wick holder.

5 Claims, 5 Drawing Figures

FIG. 1
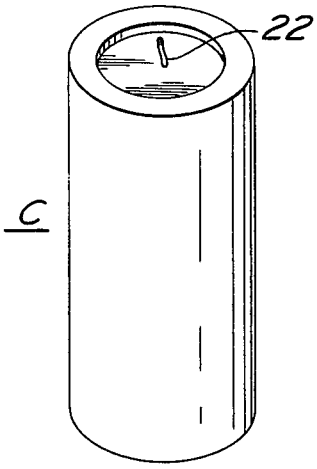
FIG. 3
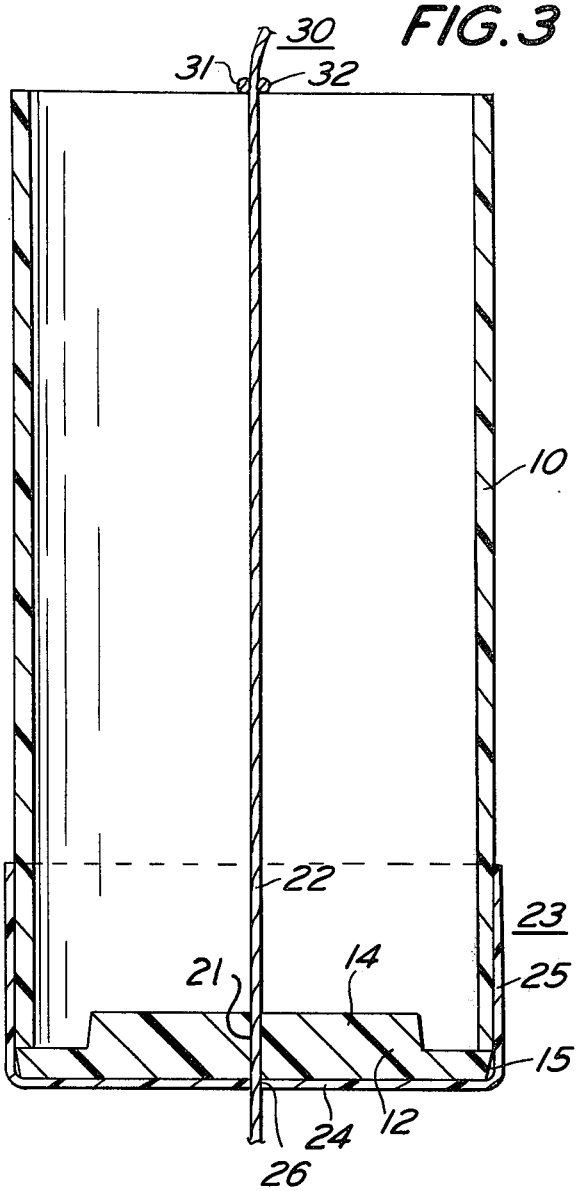
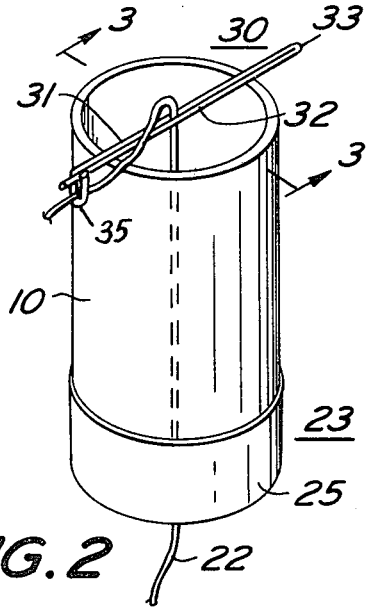
FIG. 2
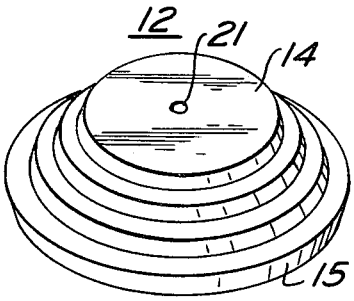
FIG. 4
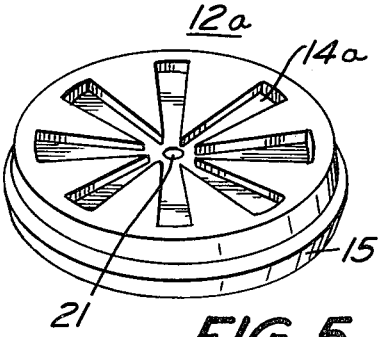
FIG. 5

CANDLE MOLD

BACKGROUND OF THE INVENTION

1. Field of the Invention

This invention relates to candle molds of the dismountable type.

2. Description of the Prior Art

It has long been desired to obtain a candle mold that is of simple construction and can be used to turn out a variety of candles in a short time.

One candle mold is shown in the patent to Schmitt et al., U.S. Pat. No. 3,759,478 where a flat base is provided with a transparent cylinder secured thereto which can receive a previously molded candle core, the wick ends of which are retained at the base and in a bar at the top.

Another candle mold is shown in the patent to Davis, U.S. Pat. No. 3,724,982 which includes a barrel open at each end threaded at one end for engagement in a base, the wick being retained in a hole in the threaded base and by a metal strap at the other end.

These and other available candle molds including that of the patent to Halvorson, U.S. Pat. No. 26,429, are not satisfactory as they require close manufacturing tolerances, tend to bind from wax adhesion during use and are limited as to the shape and pattern of the candle provided.

The mold of my invention does not suffer from the drawbacks of these structures and offers a variety of positive advantages.

SUMMARY OF THE INVENTION

A candle mold is provided which includes a barrel open at each end which has a flexible end cap over one end with an end former plate interiorly of the cap at the end of the barrel. The end cap has a hole in the center for gripping engagement of a wick which extends through a hole in the plate to the other end of the barrel where it is retained by a wick holder.

The principal object of the invention is to provide a candle mold that is simple to construct and to use.

A further object of the invention is to provide a candle mold that will produce a variety of candle designs by variation of the end former plate.

A further object of the invention is to provide a candle mold that is durable.

A further object of the invention is to provide a candle mold that is safe to use.

A further object of the invention is to provide a candle mold that is inexpensive to manufacture.

Other objects and advantageous features of the invention will be apparent from the description and claims.

BRIEF DESCRIPTION OF THE DRAWINGS

The nature and characteristic features of the invention will be more readily understood from the following description taken in connection with the accompanying drawings forming part hereof, in which:

FIG. 1 is an isometric view of a candle produced with the apparatus of my invention;

FIG. 2 is an isometric view of the candle mold;

FIG. 3 is a vertical sectional view of the candle mold taken approximately on the line 3—3 of FIG. 2;

FIG. 4 is an isometric view of one end former plate used in connection with the invention; and FIG. 5 is an isometric view of a different end former plate used in connection with the invention.

It should, of course, be understood that the description and drawings herein are illustrative merely and that various modifications and changes can be made in the structure disclosed without departing from the spirit of the invention.

Like numerals refer to like parts throughout the several views.

DESCRIPTION OF THE PREFERRED EMBODIMENTS

Referring now more particularly to the drawings, a preferred embodiment of the candle mold is shown which includes a barrel or tube 10 shown as circular but which could be square, triangular or other suitable cross sectional shape for candles. The tube 10 is illustrated as preferably being made of transparent acrylic plastic but could be of metal or of opaque plastic. The transparent wall, if used, permits observing the filling operation.

The tube 10 is open at both ends and as is provided with an end former plate 12 closing one end which plate is circular, of a diameter substantially corresponding to the outside diameter of the tube 10 and is provided with a central cylindrical raised portion 14. The plate 12 has a circumferential edge 15 which has a slight bevel facing away from the tube 10 which it engages. The plate 12 can be of any desired design either raised or in relief for shaping the end of the candle as is more clearly shown in FIG. 4.

A plate **12*a* is shown in FIG. 5 which has a floral design 14*a*.**

The plates 12 and **12*a* have a hole 21 in the center thereof which permits a wick 22 to be passed therethrough. The wick 22** can be of any suitable type such as braided string or wire as desired.

The plate 12 or **12*a* is retained against the tube 10 by a flexible end closure cap 23 which has a base portion 24 and vertical flange 25 extending upwardly therefrom for engagement with the outside of the tube 10.**

The flange 25 preferably tapers inwardly as it rises to provide gripping pressure on the tube 10.

The base 24 has a small hole 26 therein for sliding retention of the wick 22. The closure cap 23 can be made of any suitable flexible plastic material such as natural or synthetic rubber with the properties of wick retention, resistance to heat and non-adherence to wax.

The wick 22, at the end of tube 10 opposite to end closure cap 23, is held in a wick retainer pin 30 which is of any desired type. The pin 30 is shown as consisting of two bars 31 and 32 joined at the end by a spring portion 33 with the wick 22 held between them and removably engaged at the other end in a loop 35 of bar 31.

Other wick retainers can be utilized such as a plain bar or pin which provide for secure wick gripping and guide attachment and removal.

In operation, a plate 12 or **12*a* is selected by the operator. The wick 22 is forced through the hole 26 and through the hole 21 in plate 12 and pulled upwardly a distance greater than the length of tube 10. The bars 31 and 32 are separated and wick 22 placed between them and bar 32 engaged in loop 35 thereby retaining the wick 22** therein.

The plate 12 or **12*a* is placed inside flange 25 and against base 24. The tube 10 is forced into cap 23 inside of flange 25 against plate 12. The wick 22 is pulled downwardly through holes 26 and 21 to impart the desired tension and hold the retainer 30 in place on the tube 10.**

Wax can then be poured into the open end of the tube 10, allowed to harden and the completed product C as shown in FIG. 1 removed by pulling on retainer pin 30. As the candle C is removed the wick 22 is pulled upwardly until candle C is free of tube 10. The retainer 30 can then engage the wick 22 which is cut again above it and the cycle repeated.

It will thus be seen that apparatus is provided with which the objects of the invention are achieved.

I claim:

1. A candle mold which comprises a hollow tube open at each end having internal and external surfaces, a candle end former plate below said tube closing the lower end of said tube to provide the top end of the finished candle, said former plate having a hole for a wick to be passed therethrough, a flexible one piece end closure cap in gripping engagement with the external surface of said tube and said plate retaining said former plate in position on the lower end of said tube, and sealing the same from leakage, said closure cap having an opening aligned with said opening in said former plate through which said wick is adapted to extend, said closure cap opening sized to be in frictional gripping and sealing engagement with said wick but permitting manual upward movement of said wick, and wick retaining means at the upper end of the tube.

2. A candle mold as defined in claim 1 in which said former plate has a candle end shaping portion.

3. A candle mold as defined in claim 1 in which said former plate has a raised central candle end shaping portion.

4. A candle mold as defined in claim 1 in which said former plate is circular and provided with a beveled circumferential edge with which said end closure cap is in engagement.

5. A candle mold as defined in claim 1 in which said end closure cap has a tapered side wall portion enhancing the gripping engagement.

* * * * *